US005703564A

United States Patent [19]

Begum et al.

[11] Patent Number: 5,703,564

[45] Date of Patent: Dec. 30, 1997

[54] MOBILE ADVERTISING DEVICE WITH ELECTRONIC TRANSMISSION CAPABILITIES

[75] Inventors: Paul G. Begum; Gordon W. Young, both of Salt Lake City, Utah

[73] Assignee: Klever-Kart, Inc., Salt Lake City, Utah

[21] Appl. No.: 561,432

[22] Filed: Nov. 21, 1995

[51] Int. Cl.[6] ..... G08B 1/08; G09F 19/00

[52] U.S. Cl. ..... 340/539; 340/815.64; 340/815.86; 340/815.87; 362/35; 362/170; 40/430; 40/473

[58] Field of Search ..... 340/539, 565, 340/573, 540, 541, 691, 692, 693, 825.35, 815.47, 815.73, 815.77, 815.86, 815.87, 815.64, 944, 326, 330; 362/35, 170; 40/430, 431, 467, 466, 429, 470, 473, 442

[56] References Cited

U.S. PATENT DOCUMENTS

| | | | |
|---|---|---|---|
| 4,005,843 | 2/1977 | Wengel | 40/470 |
| 4,670,798 | 6/1987 | Campbell et al. | 369/19 |
| 4,853,678 | 8/1989 | Bishop, Jr. et al. | 340/573 |
| 4,970,489 | 11/1990 | Jenkins et al. | 340/691 |
| 5,097,981 | 3/1992 | Degasperi et al. | 221/231 |
| 5,420,606 | 5/1995 | Begum et al. | 345/156 |
| 5,479,153 | 12/1995 | Yi et al. | 340/815.87 |
| 5,513,084 | 4/1996 | Simpson | 362/284 |

*Primary Examiner*—Donnie L. Crosland
*Attorney, Agent, or Firm*—Bielen, Peterson & Lampe

[57] ABSTRACT

A mobile advertising device having a rotating display unit suspended from a cord that is preferably supported from a wand attached to a shelf unit in a store. The display unit has a battery powered motor that rotates a drum having a surface on which graphics are displayed and the display unit may include lights to attract the attention of customers.

13 Claims, 1 Drawing Sheet

MOBILE ADVERTISING DEVICE WITH ELECTRONIC TRANSMISSION CAPABILITIES

BACKGROUND OF THE INVENTION

This invention relates to an advertising device, particularly adapted for retail store advertising of shelf displayed items. The advertising device includes a mobile display that is suspended from a cord for rotation of surface suitable for advertisements or attracting the attention of shoppers. The mobile display is preferably electronically self-contained with an on-board power supply. The mobile advertising device is designed for suspension of the mobile display from the store ceiling or from a wand mountable to the wall or to the product shelves. The advertising device is designed to provide a focal point to attract a shopper's attention to a product or products located proximate the advertizing device. In one embodiment, the advertising device includes a signal transmitter for activating an electronic display that is incorporated on a product shelf or is mounted on a shopping cart. In such embodiment, the mobile display device includes a sensor to detect the presence of a shopper and transmit an activation signal to activate the associated electronic display.

In retail advertising, it has been found that the influence of an advertising message may be greatest when made proximate the merchandise available for purchase. This point of purchase advertising has led to an often overwhelming array of advertising messages in retail stores, particularly in large volume supermarkets where an enormous variety of products compete for limited shelf space. The product shelves in retail marketing stores include pricing tracks at the edge of each shelf. These tracks provide a support means for advertising devices such as signs, coupon dispensers and hangers for specialty items, in addition to the purpose of carrying price and product description cards. Two sided product shelves, commonly called gondolas, are suitable for market areas displaced from the walls of the store. The gondolas divide the market area into product aisles, and are frequently moveable to permit rearrangement of the marketing area. The top of a gondola is customarily flat and may carry propped signs and other supported advertising materials in addition to difficult to reach product items.

It is desirable to devise an advertising device that can be advantageously located proximate the item to be advertised without using space already used for advertising. In this manner, existing advertising materials are not displaced and the store owner may receive additional revenue for the new advertising locations. It is also desirable to devise an advertising device that is moveable to take advantage of point of purchase advertising techniques.

Because the advertising device of this invention must compete with existing materials, the device is mobile to attract the attention of the shopper and may include one or more lights for improved visibility. It is an object of this invention to provide an advertising device that may be mounted on a ceiling, wall or gondola top where electrical power may not be available. It is also an object of the invention that the positioning of the mobile display be adjustable so that the mobile display is advantageously positioned proximate the product featured.

SUMMARY OF THE INVENTION

The mobile advertising device of this invention is preferably a self-contained electronic device that is designed to position a mobile advertising display proximate a retail product in a retail store such as a supermarket or department store. The mobile advertising device is designed to suspend a mobile display from a cord so that the mobile display is positioned proximate the product featured. The suspension cord is attached to the ceiling of the establishment or from the distal end of a wand attachable to a wall or to the top of the display shelves for the advertised product.

Where a retail establishment includes free standing retail merchandise display shelves displaced from the store wall, the wand of the mobile advertising device can be advantageously mounted in a track running the length of the free standing, island display shelves. The island display shelves or gondolas typically include no electrical power, and the mobile advertising device is designed to include its own power supply to supply power to a motor for rotating a display cylinder and power the auxiliary systems including display lights and/or transmitting devices for auxiliary electronic displays.

In the preferred embodiment, the mobile advertising device includes a mounting element and a suspension cord attached to the mounting element. The mobile display is suspended at the end of the cord and includes a stationary or substantially stationary power pack with a drive motor and a rotatable outer display cylinder. Preferably, the rotatable display cylinder is cylindrical shell and includes an outer display surface for advertising visuals. The advertising visuals may be a product graphic, on simply a non-product related text or graphics that are displayed to attract the attention of the shopper. It is intended that the mobile display be located proximate the product or products featured, and that it includes low power light sound capabilities for enhanced attraction.

It is preferred that the mobile advertising device be easily moveable, and in one embodiment the mobile advertising device includes a track adapted for mounting to the top of a supermarket gondola permitting one or more wands with suspended mobile displays to be moved to any location along the length of the gondola.

DETAILED DESCRIPTION OF THE PREFERRED EMBODIMENTS

Figure 1:
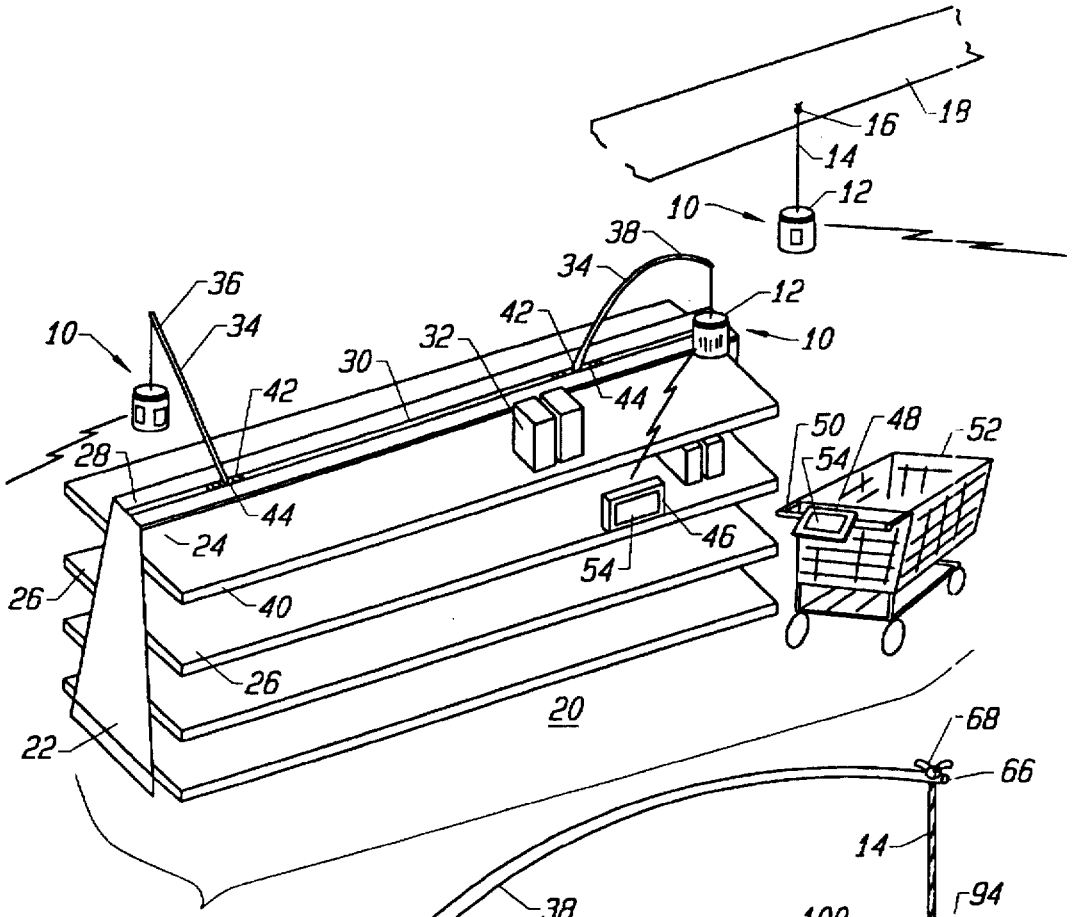
FIG. 1 is a perspective view of embodiments of the mobile advertising device in a typical marketplace.

Referring to FIG. 1, the mobile advertising device, designated generally by the reference numeral 10, is shown in three different configurations. In one configuration, a mobile display unit 12 is shown suspended from a cord 14 that is connected at one end to the display unit 12 and at the other end to a conventional connector clip 16 that secures the cord to the ceiling 18 of a marketplace 20 in which product items are sold. The marketplace 20 is any typical marketing environment such as a supermarket, department store, or other generally indoor area where goods are offered for sale.

In the marketplace 20, there are typically one or more display shelves, or gondolas for support and display of goods for sale. A typical shelf unit 22 is shown in FIG. 1. The shelf unit 22 of FIG. 1 is a stand-alone unit with a vertical shelf-back 24 from which project a plurality of horizontal shelves 26. It is to be understood that when a shelf unit 22 is positioned against a wall of the marketplace shelves will project from only one side of the shelf-back 24. Customarily, the least expensive shelf units are moveable and do not contain any electrical power requiring any device operated with electrical power to include a specially routed power line or include a self-contained power supply.

Figure 2:
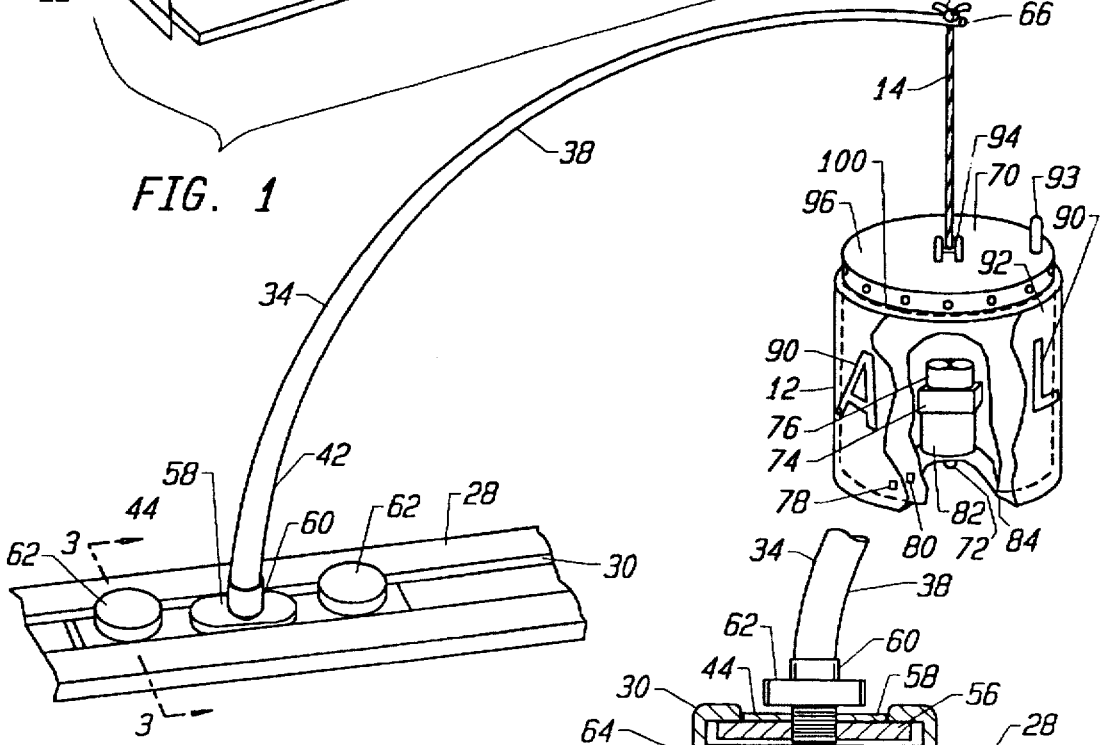
FIG. 2 is an enlarged view of one embodiment of the mobile advertising device of FIG. 1 shown partially broken away to show internal drive components.

For improved versatility of the mobile advertising device 10, the power supply for the invented device is provided by an internal battery pack 76, shown in FIG. 2, contained within the mobile display unit 12. In other configurations of the mobile advertising device 10, the mobile display unit 12 and cord 14 are identical with the suspension means varying from the simple connector 16 of the first described device.

For example, the vertical shelf-back 24 of the shelf unit 22 has a narrow, flat top or spine 28 on which a narrow connector track 30 is secured. The connector track 30 is preferably similar to the pricing tracks 32 mounted to the edge of each shelf 26. Since items, for example, boxes 32 may be supported on the uppermost shelf of the shelf unit 22. Support of the mobile display unit 12 must be such that the means for suspension does not interfere with the items 32 stocked on the uppermost shelf. Therefore, the mobile display unit 12 is suspended from a cord 14 that is attached to a wand 34 that may comprise a straight rod 36 or a curved bow 38, as shown in FIG. 1. In this manner, the mobile display unit 12 can be located in an elevated position proximate the front edge 40 of the shelves without interfering with the stock items such as the boxes 32.

The base end 42 of the wands 34 includes a connector unit 44 that engages the connector track 30. The connector unit 44 is designed to enable the mobile display unit 12 to be repositioned at any location along the connector track 30. In this manner, when it is desired that a mobile display unit 12 be repositioned proximate a new product item for purposes of bringing the customer's attention to the new item, the entire mobile advertising device 10 can be repositioned without the use of any specialty tools.

In an advanced state-of-the-art marketplace 20, various electronic display systems are available for alerting a customer of a product promotion or advertisement proximate the location of the promoted product item. The electronic display may take the form of a shelf-mounted display 46 mounted to the shelf pricing track 32 or an electronic display 48 mounted to the handle 50 of a shopping cart 52. In such systems, the motion of a customer is detected and a transmitter transmits a trigger signal to the electronic display device for display of a promotion or advertisement on a display screen 54 that is an integral part of the electronic display, 48 and 46. To accommodate for such an electronic display system, the motion detector and trigger signal transmitter must be appropriately positioned near the product items that are promoted or advertised. The suspended mobile display unit 12 is able to be ideally positioned for housing both the motion detector and trigger transmitter, for use with such electronic display systems.

Referring now to FIG. 2, the construction of the typical mobile advertising device 10 of this invention is shown in greater detail. The mobile advertising device 10 in FIG. 2 is constructed with a curved bow 38 forming the wand 34 that has a base end 42 that is mounted to the connector unit 44. The connector unit 44 includes a flat carriage 56 which slides in the connector track 30 of the shelf unit 22 of which only a portion of the flat top 28 is shown. The connector unit 44 has a socket pad 58 that is secured to the top of the carriage 56. The socket pad 58 includes a socket 60 into which the base end 42 of the wand 34 is inserted and secured. Notably, the socket may be angled for support of a straight wand 34 of the type shown in FIG. 1. To secure the position of the slidable carriage 56 in the connector track 30, a pair of thumb screws 62 on each side of the socket pad 58 are provided. It is to be understood, a single thumb screw or other securing means such as spring loaded clip means as known in the art can be used for mounting the support system for the suspended display unit 12 in a track.

Figure 3:
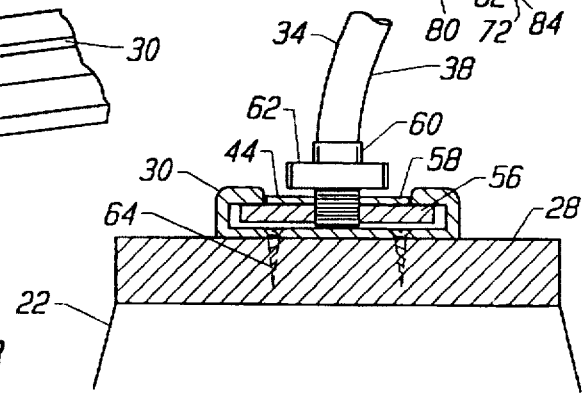
FIG. 3 is a cross sectional view taken on the lines 3—3 in FIG. 2.

As shown in the cross sectional view of FIG. 3, the thumb screw 62 is threaded through the carriage and engages the connector track 30, which is secured to the flat top 28 of the shelf unit 22 by recessed flat head screws 34. This arrangement provides a simple interconnection means for the advertising device 10 and the shelf unit 22.

The wand 34 provides a simple system for support of the mobile display unit 12, which is suspended from the cord 14 as shown in FIG. 2. The cord 14 is threaded through a hole (not visible) at the distal end 66 of the bow 38 and tied in a knot 68. The display unit 12 is constructed with a cylindrical canister 70 that provides an inner housing for a drive motor 72, a controller packet 74 and a battery pack 76, shown in the broken away section of the display unit 12. The drive motor 72 is a low power pulse drive motor that conserves energy by the electronics in the controller packet 74 delivering a short periodic pulse of current each time a reference target 78 is detected by a detector 80 electrically connected to the controller packet 74. In the system shown, the drive shaft 82 of the motor 72 is an extension of the motor armature (not shown) and is connected to the center of the bottom 84 of a rotating drum 86 positioned outside the cylindrical canister 70. As the drum 86 rotates, the reference target 78 aligns with the detector 80 once each rotation and a short pulse is sent to the motor 72 which "kicks" the drum forward. The controller packet 74 includes timing circuitry to adjust the strength and duration of the pulse to achieve a selected speed of rotation, as referenced to the timing of the feedback signal from the detector 80.

The controller packet 74 also includes circuitry to operate a series of lights 88 around the top of the canister 70. The lights may be flashed in series counter to the rotation of the drum 86 or in any manner desired as programmed by the circuitry of the controller pack 74. In this manner, the customers attention may be directed to the mobile display unit 12 and then to the rotating graphics 90 on the surface 92 of the drum 86.

In addition, the controller packet includes transmitter circuitry for periodically sending trigger signals to a remote display such as the shelf mounted display 46 or the cart mounted display 48, shown in FIG. 1. The transmitter circuitry is of conventional design and is connected to a transmitter antenna 93 on the top of the canister 70. The transmitter antenna 93 broadcasts a local trigger signal to activate a graphic promotion on the display screen 54 on one or both of the electronic displays 46 and 48. The controller packet also includes electronic circuitry of conventional design for detecting the presence of a customer by customary motion detection and activating the triggering signal only in the presence of a customer to conserve power of both said display unit 12 and the remote electronic displays 46 and 48.

The inner canister 70 is normally stationary, but may slowly rotate opposite the rotation of the drum 86 by the use of a low friction bearing 94 at the interconnection of the cord 14 and the top 96 of the canister 70. The comparative slow rotation of the canister 70 relative to the faster rotation of the drum 86 is a result of the greater inertia of the heavier canister together with its housed components.

By pulsing lights that are low power light emitting diodes and pulse diving the rotating drum, a battery pack using four standard D cells will last over a month. The canister 70 has a seam 100 allowing easy separation of the top 96 for access to the internal components and easy replacement of the batteries not visible) in the battery pack 76.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A mobile advertising device comprising:

a display unit having an inner housing with a drive motor in the inner housing, the drive motor having a power supply and an electronic controller means for operating said drive motor; an outer cylindrical graphic display structure encompassing the inner housing, wherein the display structure has a display surface substantially covering the inner housing, and wherein the drive motor has a drive shaft with means connecting the drive shaft to the outer display structure for rotating the outer display structure around the inner housing; and, suspension means connected to the inner housing for suspending the display unit from the support structure.

2. The mobile advertising device of claim 1 wherein said suspension means comprises a suspension cord connected to said housing.

3. The mobile advertising device of claim 2 including a wand having a distal end connected to the suspension cord and a base end connected to the support structure.

4. The mobile advertising device of claim 3 wherein the base end includes a connector means for mounting the mobile advertising device to the support structure.

5. The mobile advertising device of claim 4 wherein the support structure comprises a conventional marketplace shelf unit with a top, wherein the top includes a track and the connector means comprises a connector unit engageable in the track with means for moving the connector unit and connected display unit along the track.

6. The mobile advertising device of claim 5 wherein said connector unit has means for securing said connector unit in a selected location in the track.

7. The mobile advertising device of claim 5 herein the shelf unit has at least one shelf with a front edge and said wand has a length and orientation to position said display unit over the front edge of the shelf.

8. The mobile advertising device of claim 2 wherein said suspension cord has means for connecting said suspension cord to a ceiling.

9. The mobile advertising device of claim 1 wherein said housing includes light means for attracting the attention of a customer.

10. The mobile advertising device of claim 1 wherein said drive motor is a low power pulse type motor.

11. The mobile advertising device of claim 1 wherein said power supply comprises a battery pack.

12. The mobile advertising device of claim 1 wherein said advertising device is used in combination with a remote electronic display and said controller means includes transmitter means for activating said remote electronic display.

13. The mobile advertising device of claim 12 wherein said controller means includes electronic means for detecting the presence of a customer and activating said transmitter means to activate said remote electronic display when the presence of a customer is detected.

* * * * *